US007848078B2

(12) United States Patent
Hummel et al.

(10) Patent No.: US 7,848,078 B2
(45) Date of Patent: Dec. 7, 2010

(54) METHOD OF COMMUNICATION AT A BLAST SITE, AND CORRESPONDING BLASTING APPARATUS

(75) Inventors: Dirk Hummel, Hennef (DE); Charles Michael Lownds, Aurora, CO (US)

(73) Assignee: Orica Explosives Technology Pty Ltd, Melbourne (AU)

( * ) Notice: Subject to any disclaimer, the term of this patent is extended or adjusted under 35 U.S.C. 154(b) by 478 days.

(21) Appl. No.: 12/031,956

(22) Filed: Feb. 15, 2008

(65) Prior Publication Data

US 2010/0275799 A1 Nov. 4, 2010

Related U.S. Application Data

(60) Provisional application No. 60/902,008, filed on Feb. 16, 2007.

(51) Int. Cl.
*F23Q 7/00* (2006.01)

(52) U.S. Cl. ..... 361/247

(58) Field of Classification Search ..... 361/247
See application file for complete search history.

(56) References Cited

U.S. PATENT DOCUMENTS 4,556,850 A 12/1985 McBrien
4,674,047 A 6/1987 Tyler et al.
4,680,584 A 7/1987 Newsom et al.
5,014,622 A 5/1991 Jullian
5,189,246 A 2/1993 Marsh et al.
5,266,925 A 11/1993 Vercellotti et al.
5,282,421 A 2/1994 Marsh et al.
5,367,957 A * 11/1994 Hennessey ..... 102/217
5,406,890 A 4/1995 Marsh et al.
5,448,230 A 9/1995 Schanker et al.
5,457,719 A 10/1995 Guo et al.
5,520,114 A 5/1996 Guimard et al.
5,539,636 A 7/1996 Marsh et al.
5,602,713 A * 2/1997 Kurogi et al. ..... 361/249
5,621,774 A 4/1997 Ishibashi et al.

(Continued)

FOREIGN PATENT DOCUMENTS

EP 0 096 482 A2 12/1983

(Continued)

OTHER PUBLICATIONS

Touch, Joseph D., "Parallel Communication", USC/Information Sciences Institute, http://www.isi.edu/div7/publication_files/rs-93-342.pdf.

(Continued)

*Primary Examiner*—Stephen W Jackson
(74) *Attorney, Agent, or Firm*—Choate, Hall & Stewart; Jeffrey E. Buchholz

(57) ABSTRACT

Blasting operations for mining frequently involve a large number of detonators for a single blasting event. An important step in the execution of a blast is to perform a roll-call to check that all detonator assemblies placed at the blast site are in communication with a blasting machine, and forming operative components of the blasting apparatus. Disclosed herein are blasting apparatuses and methods of blasting that streamline this roll-call step, thereby reducing time consumed in the blasting process.

28 Claims, 6 Drawing Sheets

U.S. PATENT DOCUMENTS

| | | | | |
|---|---|---|---|---|
| 5,627,544 | A | 5/1997 | Snodgrass et al. | |
| 5,883,582 | A | 3/1999 | Bowers et al. | |
| 6,000,338 | A | 12/1999 | Shann | |
| 6,173,651 | B1 | 1/2001 | Pathe et al. | |
| 6,354,374 | B1 | 3/2002 | Edwards et al. | |
| 6,789,483 | B1 | 9/2004 | Jennings, III et al. | |
| 6,837,163 | B2 | 1/2005 | Hallin et al. | |
| 6,851,369 | B2 | 2/2005 | Hummel et al. | |
| 6,892,643 | B2 | 5/2005 | Jennings, III | |
| 6,941,870 | B2 * | 9/2005 | McClure et al. | 102/311 |
| 6,966,262 | B2 | 11/2005 | Jennings, III | |
| 6,975,676 | B1 | 12/2005 | Goodson et al. | |
| 6,988,449 | B2 | 1/2006 | Teowee et al. | |
| 7,013,407 | B2 | 3/2006 | Johansen et al. | |
| 7,017,494 | B2 | 3/2006 | Kouznetsov | |
| 7,036,037 | B1 | 4/2006 | Paul et al. | |
| 7,053,754 | B2 | 5/2006 | Mani | |
| 7,054,131 | B1 | 5/2006 | Kanth et al. | |
| 7,064,690 | B2 | 6/2006 | Fowler et al. | |
| 7,069,458 | B1 | 6/2006 | Sardi et al. | |
| 7,088,246 | B2 | 8/2006 | Fukuoka | |
| 7,107,908 | B2 | 9/2006 | Forman et al. | |
| 7,260,651 | B2 | 8/2007 | Parrella, Sr. et al. | |
| 7,370,583 | B2 | 5/2008 | Hallin et al. | |
| 2003/0078964 | A1 | 4/2003 | Parrella, Sr. et al. | |
| 2003/0136289 | A1 | 7/2003 | Hallin et al. | |
| 2005/0011390 | A1 | 1/2005 | Jennings, III | |
| 2005/0188871 | A1 | 9/2005 | Forman et al. | |
| 2005/0190525 | A1 | 9/2005 | Jennings, III | |
| 2005/0279238 | A1 | 12/2005 | Jennings, III | |
| 2006/0130693 | A1 | 6/2006 | Teowee | |
| 2006/0249045 | A1 | 11/2006 | Goodman et al. | |

FOREIGN PATENT DOCUMENTS

| | | | |
|---|---|---|---|
| EP | 0 639 004 | A1 | 2/1995 |
| GB | 2093286 | A | 8/1982 |
| JP | 4330554 | | 11/1992 |
| JP | 5075594 | | 3/1993 |
| JP | 2004/248310 | | 9/2004 |
| WO | WO 93/25948 | A1 | 12/1993 |
| WO | WO 2004/020934 | A1 | 3/2004 |
| WO | WO 2006/050542 | A1 | 5/2006 |
| WO | WO 2007/051231 | A1 | 5/2007 |
| ZA | 20004542 | | 5/2001 |

OTHER PUBLICATIONS

Schmidt, Douglas and Suda, Tatsuya, "The Performance of Alternative Threading Architectures for Parallel Communication Subsystems", Journal of Parallel and Distributed Computing, http://www.cs.wustl.edu/~schmidt/PDF/JPDC-96-pdf.

Schmidt, Douglas and Suda, Tatsuya, "Measuring the Performance of Parallel Message-based Process Architectures", Proceedings of the INFOCOM Conference on Computer Communications, IEEE, Boston, MA, Apr. 1995, http://www.cs.wustl.edu/~schmidt/PDF/INFOCOM-94.pdf.

Coursework.Info article, "Communication Methods: Principles of Electronic Data Communication", submitted Mar. 31, 2006, www.coursework.info/University/Mathematical_and_Computer_Sciences/Computer_Science/Principle_of_Electronic_Data_Communicati_L78050.html.

Khan, A.I., Isreb, M., Spindler, R.S., 2004, "A Parallel Distributed Application of the Wireless Sensor Network", Proceedings of the Seventh International Conference on High Performance Computing and Grid in Asia Pacific Region (HPCAsia'04), pp. 81-88.

Timing Products, http://tpg.conwin.com/pages/home.html.

Fakhry, Lisa, "Timing-Control Module Supports 14 Input Signals", http://www.elecdesign.com/Articles/Index.cfm?ArticleID=2741.

Balluff, "Sensor Systems AS-Interface®", http://www.balluff.ru/pdf/asi/Asi_7.pdf.

Schlumberger, "eFire-Slickline Electronic Firing Head System", http://www.oilfield.slb.com/media/services/perforating/slickline/efire_slickline.pdf?seg=www.pipesim.com.

Parallel Communication Overview, http://www.quatech.com/support/comm-overr-parallel.php.

Parker et al., "Managing AIX Server Farms", IBM Redbooks, http://www.redbooks.ibm.com/redbooks/pdfs/sg246606.pdf.

RTU32 User Guide, V.1.04, May 2006, http://66.102.7.104/search?q=cache:v161W6oJp04J:www.brodersencontrols.com/docs/MRTU32UG.pdf+timing+%22without+serial+communication%22&hl=en&gl=us&ct=clnk&cd=1.

MAGFLO® Electromagnetic flowmeters, Product manual, http://www.schillig.com.ar/hojas_de_ datos/Danfoss/Magneticos_DS.pdf.

Kio, Su long, Manthe, Alicia and Vujkovic, Miodrag, "EE540—Final Project—Testing the 8051 8-bit Microcontroller", http://www.ee.washington.edu/research/vlsilab/miodrag/research/finaltestingproject.doc.

Computer Hardware Components, http://media.wiley.com/product_data/excerpt/57/07821443/0782144357.pdf.

Hummel, D. and Reinders, P., "A Centralised Digital Blasting System", R&D Electronic Blasting Systems, Orica Germany GmbH, http://www.i-konsystem.com/news/Hummel-Reinders%20Prag03.pdf.

Watson, John T., "Developments with Electronic Detonators", http://www.dynonobel.com/NR/rdonlyres/A0AB000B-AA62-4E2E-9891-815BA2BACA1C/0/ElectronicDetonators.pdf.

Patent Abstracts of Japan, 04330554, "Parallel Processor", Nov. 18, 1992, Daburiyuu Danieru Hirisu.

Patent Abstracts of Japan, 05075594, "Parallel Bit Synchronizing System", Mar. 26, 1993, Nagara Shigenori.

Patent Abstracts of Japan, 2004-248310, Data Processing Method for RFID Tag and Interrogator (Reader/Writer), Sep. 2, 2004, Fukuoka Shinichiro.

* cited by examiner

METHOD OF COMMUNICATION AT A BLAST SITE, AND CORRESPONDING BLASTING APPARATUS

CROSS-REFERENCE TO RELATED APPLICATION

This application claims the priority right of prior U.S. patent application Ser. No. 60/902,008 filed on Feb. 16, 2007 the entire contents of which are hereby incorporated by reference.

FIELD OF THE INVENTION

The present invention relates to the field of blasting, such as for mining operations. In particular, the invention relates to communication with detonators or other components of a blasting apparatus at a blast site.

BACKGROUND TO THE INVENTION

Electronic blasting systems typically employ one or more blasting apparatuses located in or near a vicinity of the blast site, in communication with a blasting array comprising a plurality of detonators or detonator assemblies positioned at the blast site. Typically, each detonator includes an outer casing, a base charge, and means to achieve instantaneous or delayed actuation of the base charge upon receipt from a blasting machine of a command signal to FIRE. If required, each detonator may form a component of a larger detonator assembly adapted to cause actuation of a larger explosive charge to achieve rock fragmentation at the blast site. For example, each detonator may be positioned in a booster, such that actuation of the base charge of the detonator causes actuation of a portion of explosive material in the booster. Moreover, the booster may be located adjacent, for example, an explosive emulsion composition located down a borehole, such that actuation of the booster causes ignition of the explosive emulsion composition.

Prior to blasting machine/detonator communication, the blasting array is established at the blast site. The detonators, and optionally associated components, are positioned at desired locations in or near rock at the blast site, either at or near a surface of the ground, or underground. The detonators are usually placed in boreholes which are subsequently charged with explosive. Communication is then established between each blasting machine and its associated detonator assemblies. Such communication may involve wired communication, or any means of wireless communication. In any event, it is desirable to achieve two-way communication with the detonator assemblies, so that the blasting machine may communicate with the detonator assemblies, and if required the detonator assemblies may respond. For example, a blasting machine may transmit command signals (e.g. ARM, DISARM, or FIRE signals) to a detonator assembly that require no response. However, at other times a blasting machine may send an inquiry signal to assess a status of a detonator assembly at the blast site, wherein the inquiry signal requires the detonator assembly to respond in some way, for example to confirm the operating status of the detonator, information programmed into the detonator assembly (e.g. detonator identity, delay times for firing etc.), or the environmental conditions of the detonator assembly. Reliable two-way communication between one or more blasting machines, and a plurality of detonators at a blast site, either via wired or wireless communication, is of increasing importance for modern electronic blasting systems.

Each blasting machine may be programmed with identity information for each associated detonator assembly, so that detonators can be addressed by a blasting machine on an individual basis. For example, each blasting machine may retrieve identity information directly from a detonator assembly via direct two-way communication therewith. Alternatively, each blasting machine may be pre-programmed with detonator identification information, such as factory allocated detonator identification codes that are programmed into the detonator assemblies upon manufacture. In other mining operations, each detonator assembly (or corresponding detonator assembly) positioned at the blast site may be 'visited' by a blast operator carrying a portable electronic device such as a logger. A logger communicates via short-range communication with each detonator to generate and store a detonator list for the blast array comprising, for example, detonator identification codes, and optionally firing times for the detonators, which may be optionally programmed into the detonator assemblies by the logger. The detonator list may then be transferred from the logger to each blasting machine, thereby to make each blasting machine 'aware' of the detonators in the blasting array. Once the blasting machines are programmed in some way with the detonator identification information, the detonator assemblies are ready to be individually addressed by their associated blasting machine.

Typically prior to blasting machine/detonator assembly communication, the blast site is made safe for blasting by clearing all blasting personnel, mining equipment and vehicles a sufficient distance from the blast site to avoid any hazards (e.g. flyrock) resulting from the blast. As a result, all production operations within or near the blast zone must be stopped, to provide a time window for checking the operability of the blasting array, and execution of the blasting event. It is desirable for the time window to be as short as possible, so that stoppage of production operations can be minimized. In addition, a shorter time window would reduce the possibility that the safety and security of the blast site is compromised, for example by a person entering the blast zone before the blasting event is complete.

There remains a continuing need to develop methods of blasting, and corresponding blasting apparatuses suitable for application of such methods, that permit a blasting event to be conducted more rapidly, more efficiently, and more safely. In particular, two-way communication between a blasting machine and detonator assemblies can be time consuming. Therefore, there remains a need to shorten the time window required for a blasting event, including the time required to establish and/or verify communication between one or more blasting machines, and a plurality of detonators or detonator assemblies.

SUMMARY OF THE INVENTION

It is an object of the present invention, at least in preferred embodiments, to provide a blasting apparatus that permits efficient communication with a plurality of detonators or detonator assemblies.

It is another object of the present invention, at least in preferred embodiments, to provide a method for efficient communication between at least one blasting machine, and a plurality of detonators or detonator assemblies.

In one aspect, the present invention provides a blasting apparatus comprising:

(1) at least one blasting machine for transmitting at least one command signal to at least two associated detonator assemblies, at least including an all-acknowledge command signal for receipt by said at least two detonator assemblies;

(2) at least two detonator assemblies, each detonator assembly comprising:

(i) a detonator including a base charge;

(ii) a memory for storing an anti-collision response time;

(iii) a clock for counting down the anti-collision response time upon receipt from said at least one blasting machine of said all-acknowledge command signal; and (iv) a transmitter for transmitting an acknowledge signal in response to said all-acknowledge command signal, upon expiry of said anti-collision response time;

and (3) at least one receiver, optionally integrated into said at least one blasting machine, for receiving said acknowledge signals from said detonator assemblies, and differentiating each acknowledge signal from at least one other acknowledge signal in accordance with its time of receipt, thereby to verify communication with each detonator assembly of said blasting apparatus. Preferably, each receiver differentiates each acknowledge signal from every other received acknowledge signal.

In another aspect the present invention provides a detonator assembly for use in connection with the blasting apparatus of the present invention, the detonator assembly comprising:

(i) a detonator including a base charge;

(ii) a dedicated memory for storing an anti-collision response time;

(iii) a clock for counting down an anti-collision response time when stored in the memory upon receipt from a blasting machine of an all-acknowledge command signal; and (iv) a transmitter for transmitting an acknowledge signal in response to said all-acknowledge command signal, upon expiry of said anti-collision response time.

In another aspect, the present invention provides a method for checking that at least two detonator assemblies form operative components of a blasting apparatus at a blast site, the method comprising the steps of:

(1) programming each detonator assembly with an anti-collision response time;

(2) transmitting from at least one blasting machine an all-acknowledge command signal for receipt by the detonator assemblies, to cause each detonator assembly to count-down its programmed anti-collision response time;

(3) transmitting from each detonator assembly, upon completion of count-down of its programmed anti-collision response time, an acknowledge signal to at least one receiver optionally forming part of said at least one blasting machine, a time of receipt by said at least one receiver of each acknowledge signal occurring at a time different to a time of receipt of at least one other acknowledge signal, thereby permitting differentiation of said acknowledge signals by said receiver, and providing confirmation that each detonator assembly forms a operative component of the blasting apparatus.

In another aspect the present invention provides a blasting apparatus comprising:

(1) at least one blasting machine for transmitting at least one command signal to at least two associated detonator assemblies, at least including an all-acknowledge command signal for receipt by said at least two detonator assemblies;

(2) at least two detonator assemblies, each detonator assembly comprising:

(i) a detonator including a base charge;

(ii) a memory for storing an identification parameter for the detonator assembly;

(iii) a transmitter for transmitting upon receipt of said all-acknowledge command signal from said at least one detonator assembly, an acknowledge signal characteristic of said identification parameter;

and (3) at least one receiver, optionally integrated into said at least one blasting machine, for receiving said acknowledge signals from said detonator assemblies, and differentiating each acknowledge signal in accordance with its identification parameter, thereby to verify two-way communication with each detonator assembly of said blasting apparatus.

In another aspect the present invention provides a method for checking that at least two detonator assemblies form operative components of a blasting apparatus at a blast site, the method comprising the steps of:

(1) programming each detonator assembly with an identification parameter;

(2) transmitting from at least one blasting machine an all-acknowledge command signal for receipt by the detonator assemblies;

(3) transmitting from each detonator assembly, in response to said all-acknowledge command signal, an acknowledge signal indicative of its identification parameter, to at least one receiver optionally forming part of said at least one blasting machine, said at least one receiver differentiating said acknowledge signals in accordance with their identification parameters, thereby permitting differentiation of said acknowledge signals by said receiver, and confirmation that each detonator assembly forms a functional component of the blasting apparatus.

In another aspect the present invention provides a use of a blasting apparatus of the present invention, to verify communication with components of the blasting apparatus.

In another aspect the present invention provides a use of a blasting apparatus of the present invention, in a mining operation.

DEFINITIONS

Figure 1:
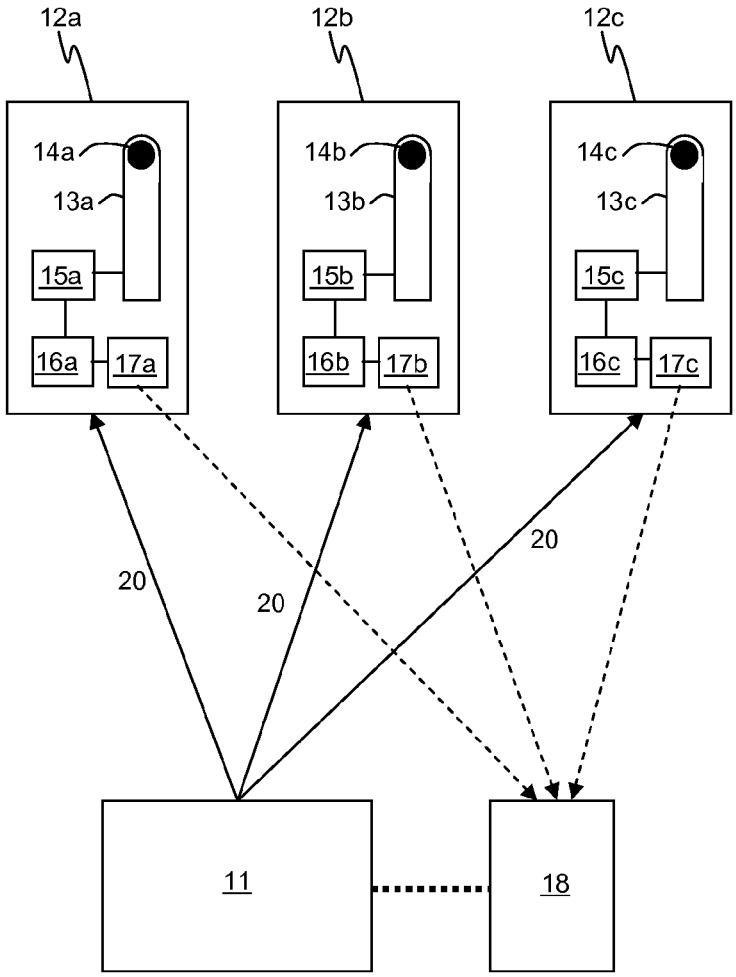
FIG. 1 schematically illustrates a preferred blasting apparatus of the present invention.

Acknowledge signal: refers to any signal transmitted across a wired connection (e.g. including branch lines and trunk lines) or via a wireless transmission, that is transmitted by a detonator or detonator assembly to one or more other components of a blasting apparatus to inform those other components that the detonator or detonator assembly is present and in operative working order such that it can form a functional part of the blasting apparatus. Typically, in accordance with the present invention, an acknowledge signal may be transmitted by a detonator assembly in response to receipt by the detonator assembly from another component of the blasting apparatus (e.g. a blasting machine) of an "all-acknowledge command signal". Preferably, the acknowledge signal is not complex, but sufficient to convey the message "this detonator assembly is present and properly functioning". In other embodiments, the acknowledge signal may further include more complex information, for example to convey the status of the detonator assembly, identity of the detonator assembly, or delay time for the detonator assembly. Preferably, the acknowledge signal will be identifiable upon receipt (for example by a receiver) by virtue of an identification parameter indicative of the acknowledge signal and the detonator assembly from which it is derived. The act of transmission of the acknowledge signal may be active—electrical energy discharged by the detonator into the wiring harness connecting it to the blasting machine, or passive—the detonator changes its apparent impedance to the blasting machine for example by clamping the line.

All-acknowledge command signal: refers to any signal transmitted across a wired connection (e.g. including branch lines and trunk lines) or via a wireless transmission, that is transmitted by a blasting machine to at least two detonator assemblies in a blasting apparatus to request a response from the detonator assemblies indicative that the detonator assemblies are present and forming functioning components of the blasting apparatus. Typically, an all-acknowledge command signal is transmitted for simultaneous or near simultaneous receipt by multiple detonators or detonator assemblies at a blast site. The all-acknowledge command signal may take any form suitable to cause the associated detonator assemblies to respond by way of the transmission of an acknowledge signal. In preferred embodiments, an all-acknowledge signal has a duration sufficient to ensure receipt by all detonators at a blast site.

Anti-collision response time: refers to a time period programmed into a detonator assembly that is counted down by a clock in the detonator assembly upon receipt by the detonator assembly of an all-acknowledge command signal. The anti-collision response time may be programmed into the detonator assembly in any suitable way, including pre-programming upon manufacture of the detonator assembly, or the anti-collision response times may be programmed into the detonator assembly whilst in situ at the blast site, for example using a portable programming device such as a logger. Upon completion of the countdown of an anti-collision response time, each detonator assembly typically transmits an acknowledge signal. In selected embodiments of the invention, each detonator at a blast site is programmed with an anti-collision response time that is different from at least one other, preferably all other, detonators at the blast site. If two or more detonators have the same anti-collision response times, then the receiver preferably differentiates the acknowledge signals received from those detonators in some other way (e.g. the acknowledge signals may have different characteristics such as different frequencies).

Base charge: refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

Blasting machine: any device that is capable of being in signal communication with electronic detonators, for transmitting signals to and/or from associated detonators or detonator assemblies, typically but not necessarily from a location remote from the detonators, via wired or wireless signal communication. For example, a blasting machine may transmit command signals to the detonators or detonator assemblies such as ARM, DISARM, FIRE and all-acknowledge command signals. A blasting machine may transmit data to program detonators or detonator assemblies with information relevant to a blast, such as for example delay times, detonator ID information, anti-collision response times etc. A blasting machine may also be capable of receiving information from associated detonators or detonator assemblies such as detonator status information, positional information, detonator ID information, acknowledge signals, or delay times relating to or programmed into the detonators or detonator assemblies. For example, a blasting machine may receive acknowledge signals from the detonator assemblies indicative of the detonators or detonator assemblies from which they are derived, for the purposes of conducting roll-call of properly functioning, associated detonators or detonator assemblies. Signals may be received by a blasting machine directly from associated detonators or detonator assemblies. Alternatively, this data received from the detonators or detonator assemblies may be received via a receiver associated with or integral with the blasting machine. Alternatively, data transfer between a blasting machine and its associated detonators may at least in part be achieved via a logger. Preferably, the blasting machine may be the only piece of equipment at the blast site controlling a blast, or a blasting machine may work in concert with other blasting machines or with other blasting equipment during the preparation for and/or during the execution of a blast.

Central command station: refer to any device that transmits signals via radio-transmission or by direct connection, to one or more blasting machines. The transmitted signals may be encoded, or encrypted. Typically, the central blasting station permits radio communication with multiple blasting machines from a location remote from the blast site.

Clock: encompasses any clock suitable for use in connection with a wireless detonator assembly and blasting system of the invention, for example to time delay times for detonator actuation during a blasting event. In selected embodiments, the term clock relates to a crystal clock, for example comprising an oscillating quartz crystal of the type that is well know, for example in conventional quartz watches and timing devices. Crystal clocks may provide particularly accurate timing in accordance with preferred aspects of the invention. The clock that performs the countdown of the anti-collision response time and the clock that times the main delay after the FIRE command may or may not be the same clock.

Detonator: refers to any detonator that includes a base charge actuatable upon receipt by the detonator of a command signal to FIRE. Typically a detonator will include a detonator shell for retaining the base charge and other components of the detonator if present. Such other components may include means to receive and/or process incoming command signals, or optionally memory means to store data including but not limited to: detonator identification codes, firing times, delay times, anti-collision response times etc. The term "detonator" may be interchanged with "detonator assembly" if appropriate.

Detonator assembly: refers to any assembly that comprises a detonator (comprising in its minimal form a base charge actuatable upon receipt by the detonator of a command signal to FIRE) together with at least one other component. Such other components may include, but are not limited to: means to receive and/or process incoming command signals, or optionally memory means to store data including but not limited to: detonator identification codes, firing times, delay times, anti-collision response times etc., a booster housing, a booster explosive charge, an explosive charge, a transmitter, a receiver, a transceiver etc. Depending upon context the expression "detonator assembly" may be interchanged with "detonator" if appropriate.

Dedicated memory: refers to a memory specifically intended for receiving and recording an anti-collision response time. The dedicated memory may be the same or different to a memory of a detonator or detonator assembly for storing other data including but not limited to delay times, detonator identification information etc.

Identification parameter: refers to any feature or characteristic of a detonator or detonator assembly, or signals derived therefrom, that enable a component of a blasting apparatus to differentiate each detonator or detonator assembly from at least one other, preferably all other, detonators or detonator assemblies at a blast site. Typically, acknowledge signals transmitted by a detonator or detonator assembly may include such a parameter so that upon their receipt by a receiver they can be differentiated from one another, and the detonators or detonator assemblies from which each acknowledge signal is derived can be identified. In this way, identification parameters may be used to identify a detonator during a roll-call of detonators in accordance with the teachings of the present invention. For example, such a parameter may be a feature of an acknowledge signal transmitted by a detonator as part of a roll-call instigated by transmission to the detonator (and other detonators) of an "all-acknowledge signal". For example, the parameter may be selected from one or more of the following non-limiting list of options: a time of transmission of the acknowledge signal, a frequency of the acknowledge signal, a nature of the acknowledge signal, a form of energy used for the acknowledge signal, a delay time of a detonator, an identification code for a detonator, a capacitor voltage of a detonator assembly, a duration of the acknowledge signal. Identification parameters may be combined, in selected embodiments, to further permit or facilitate detonator identification. For example, detonators at a blast site may be organized into groups, with each group transmitting acknowledge signals at a different frequency to all other groups. This may allow each group to transmit acknowledge signals in a simultaneous sequence without collision between groups. Logger/Logging device: includes any device suitable for recording information with regard to a detonator assembly, or a detonator contained therein. The logger may transmit or receive information to or from a detonator assembly of the invention or components thereof. For example, the logger may transmit data such as, but not limited to, detonator identification codes, delay times, synchronization signals, firing codes, positional data, detonator assembly identification parameters (e.g. frequencies or anti-collision response times) etc. Moreover, the logger may receive information from a detonator assembly including but not limited to, identification codes, firing codes, delay times, information regarding the environment or status of the detonator assembly, information regarding the capacity of the detonator assembly to communicate with an associated blasting machine. Preferably, the logging device may also record additional information such as, for example, identification codes for each detonator, information regarding the environment of the detonator, the nature of the explosive charge in connection with the detonator etc. In selected embodiments, a logging device may form an integral part of a blasting machine, or alternatively may pertain to a distinct device such as for example, a portable programmable unit comprising memory means for storing data relating to each detonator, and preferably means to transfer this data to a central command station or one or more blasting machines. One principal function of the logging device, is to record a presence of the detonator assembly so that the detonator assembly or detonator contained therein can be "found" by an associated blasting machine, and have commands such as FIRE commands directed to it as appropriate. A logger may communicate with a detonator assembly either by direct electrical connection (interface) or a wireless connection of any type known in the art, such as for example short range RF, infrared, Bluetooth etc.

Preferably: identifies preferred features of the invention. Unless otherwise specified, the term preferably refers to preferred features of the broadest embodiments of the invention, as defined for example by the independent claims, and other embodiments of the invention disclosed herein.

Receiver: refers to any device capable of receiving and processing at least one acknowledge signal from at least one detonator. In selected embodiments the receiver may be pre-programmed to "expect" to receive acknowledge signals from, for example, detonators 1 to 20. The programming of the receiver may include detonator identification codes transmitted with the acknowledge signals so that upon processing the received acknowledge signals the receiver can compare the detonators from which acknowledge signals have been received to those detonators from which acknowledge signals were expected. Alternatively, the receiver may "expect" to receive such acknowledge signals for example in a predetermined sequence at pre-programmed times. Alternatively, the receiver may rely upon incoming acknowledge signals for information regarding the expected number and type of incoming acknowledge signals, so that it may conduct a useful and reliable roll-call of the detonators. For example, the first detonator may transmit an acknowledge signal to the receiver indicating that it is "detonator 1 of 20 detonators present", the second detonator may transmit an acknowledge signal to the receiver indicating that it is "detonator 2 of 20 detonators present", and so forth. In this way, the receiver may not require any pre-programming as to what acknowledge signals to "expect" from the array of detonators. In any event, regardless of how the receiver learns to "expect" a particular series or sequence of acknowledge signals, the receiver may at least in preferred embodiments recognize when any particular detonator fails to transmit an acknowledge signal, or recognize whether the receiver fails to receive an acknowledge signal, from a particular detonator. In this way, the receiver may detect which detonators have failed the roll-call. The receiver may form a separate device to all other components of the blasting apparatus. Preferably, for convenience the receiver may form an integral component of a blasting machine, and optionally communicate with internal components of the blasting machine in controlling the blasting event.

Wireless: refers to there being no physical wires (such as electrical wires, shock tubes, LEDC, or optical cables) connecting a detonator or detonator assembly or components thereof to an associated blasting machine or power source. Wireless communication techniques may involve, for example, radio signals (including short-range radio signals such as Bluetooth), infrared or other forms of electromagnetic energy. Wireless communication signals include, at least in selected embodiments, the use of low-frequency (LF) electromagnetic energy having for example a frequency in the range of 20-2500 Hz.

Portable programming device: refers to any device that is movable, preferably manually, between components of a blasting apparatus placed or positioned at a blast site, wherein the device is able to transfer data onto or record data from, those components. For example, a portable programming device may transfer data to a detonator assembly such as but not limited to a detonator identification code, a delay time, a firing code, or an anti-collision response time. Alternatively, or additionally, a portable programming device may retrieve data from a detonator assembly such as detonator status information, detonator identification information, firing codes, delay times etc. A preferred portable programming device is a logger.

DETAILED DESCRIPTION OF CERTAIN EMBODIMENTS OF THE INVENTION

Electronic blasting systems sometimes employ hundreds, or even thousands, of detonators, under the control of one or more blasting machines, for executing a single blasting event. Reliable, yet rapid communication between such detonators (or corresponding detonator assemblies) and the associated blasting machines represents a significant challenge.

For a typical blasting array, a key step in the execution of a blasting event is the initial "roll-call" by the blasting machine. This roll-call involves the transmission of a roll-call signal by each blasting machine to each of its associated detonators or corresponding detonator assemblies, to request that each detonator assembly acknowledge that it is present and operating as a functional component of the blasting apparatus. To date, blasting apparatuses typically employ a roll-call process involving serial communication between each blasting machine and its associated detonator assemblies. This results in each blasting machine addressing a specific detonator assembly, and waiting for a response from that detonator assembly (e.g. to confirm that it is working properly in the context of the blasting apparatus) before the next detonator assembly is then addressed.

A roll-call that employs serial communications presents one principal advantage: since detonator assemblies are addressed by the blasting machine on an individual basis they do not need to identify themselves when responding. During serial communications each roll-call signal transmitted by the blasting machine includes coding to ensure that it is received and/or acted upon only by a specific detonator assembly or group of detonator assemblies. Other detonator assemblies in the array, to which the roll-call signal is not directed, may be simply incapable of receiving such a signal from the blasting machine. Alternatively such other detonator assemblies may receive and process the roll-call signal, but recognize that they are not required to respond. In any event, with serial communications any response signal transmitted by a detonator assembly in response to receipt of a roll-call signal need not include complex coding to inform the blasting machine of its identity. The blasting machine will already be aware of the identity of each responding detonator, since each detonator assembly is specifically addressed in sequence.

Therefore, the use of serial communications for conducting a roll-call of detonator assemblies at a blast site permits each blasting machine to assume primary responsibility for accurate, individual interrogation of each detonator assembly, thereby to confirm its status in the blasting array. The detonator assemblies are merely required to respond when requested to do so by a blasting machine. The inventors recognize, however, that there are also significant disadvantages to the use of serial communications for roll-call of the detonator assemblies. Serial communications can be very time consuming. Often, a blasting machine will transmit a roll-call signal to a detonator assembly in a blasting array, and the detonator assembly (or components associated therewith) will then process and, if required, respond to the roll-call signal. A significant amount of time may be required for signal transmission to and from the detonator assemblies. Yet further time may be required for signal receipt and processing by the detonator assembly, and also by a receiver (optionally associated with a blasting machine) receiving a response signal from the detonator assembly. In serial communications, a blasting machine will typically wait for a response from a first detonator assembly before attempting to communicate with the next detonator assembly in the blasting array. As such, the total time to complete the entire roll-call of detonator assemblies will be the sum of the time for serial roll-call communication with each detonator assembly in the blasting array. It follows that the total time for the roll-call may extend to several, perhaps many minutes.

For example, in wired blasting systems, parallel wires may be used (e.g. branch and trunk lines) to connect each blasting machine to each detonator assembly in the blasting array. Often, the nature of the blasting apparatus, and the type of wiring used, may allow for relatively low baud rates, which depend largely on the frequency of the communications carrier and/or the capacitance of the system. In a typical blasting apparatus for surface mining, the surface harness wire may be 3-12 m long per detonator assembly in the blasting array. Further, in-hole wiring may extend a further 5-60 m per borehole into which a detonator assembly is placed. For larger blasts, therefore, the total length of wire used to connect the components of the blasting apparatus may exceed 20 km. At a capacitance of 50 pF per meter, the capacitance of such a system will be up to several μF. This level of capacitance can limit the frequency of the communications carrier to less than about 10 kHz. This in turn can limit the communications time for roll-call of each detonator assembly to about 1 second. It follows that for a blast event involving 1000 detonator assemblies, the time required for the total roll-call using serial communication will be about 17 minutes.

As previously discussed, time is of the essence when conducting a blast event. Typically prior to blasting machine/detonator assembly communication, the blast site is made safe for blasting by clearing all blasting personnel, mining equipment and vehicles a sufficient distance from the blast site to avoid any hazards (e.g. flyrock) resulting from the blast. As a result, all production operations within or near the blast zone must be stopped, to provide a time window for checking the operability of the blasting array, and executing the blasting event. It is desirable for the time window to be as short as possible, so that stoppage of production operations can be minimized. In addition, a shorter time window reduces the possibility that the safety and security of the blast site is compromised, for example by a person entering the blast zone before the blasting event is complete.

The apparatuses and methods of the present invention allow for reduced time delays for detonator assembly roll-calls at the blast site. The apparatuses and methods employ parallel communications in a manner that allows responding detonator assemblies to identify themselves in a simple and definite manner. Through significant inventive ingenuity, the inventors have developed blasting apparatuses and methods in which the detonator assemblies, preferably in response to a single, broadcasted roll-call signal from a blasting machine, each transmit a response signal having some form of identifying feature to allow the response signals to be differentiated by the receiver, and their source detonator assembly identified. In this way, the detonator assemblies may respond in parallel, or within a limited time frame, thereby reducing the overall time for the roll-call.

In one exemplary embodiment of the present invention there is provided a blasting apparatus comprising:

(1) at least one blasting machine for transmitting at least one command signal to at least two associated detonator assemblies, at least including an all-acknowledge command signal for receipt by said at least two detonator assemblies;

(2) at least two detonator assemblies, each detonator assembly comprising:

(i) a detonator including a base charge;

(ii) a memory for storing an identification parameter for the detonator assembly;

(iii) a transmitter for transmitting upon receipt of said all-acknowledge command signal from said at least one detonator assembly, an acknowledge signal characteristic of said identification parameter;

and (3) at least one receiver, optionally integrated into said at least one blasting machine, for receiving said acknowledge signals from said detonator assemblies, and differentiating each acknowledge signal from at least one other acknowledge signal, in accordance with its identification parameter, thereby to verify two-way communication with each detonator assembly of said blasting apparatus.

The identification parameter for the detonator assembly may take any form providing it is sufficient and suitable to distinguish each detonator assembly from every other detonator assembly at the blast site. For example, in selected embodiments of the invention the identification parameter may take the form of a transmission frequency for each detonator assembly. Each detonator assembly may only respond by transmission of an acknowledge signal having a specific frequency that is different to the transmission frequency of other detonator assemblies at the blast site. In this way, the receiver, which is capable of receiving acknowledge signals having a range of frequencies, may differentiate the acknowledge signals by virtue of their frequencies. Preferably, the receiver may be pre-programmed so that it is "aware" of the detonator assemblies present at the blast site, and the frequencies at which they transmit their acknowledge signals. In this way, a blasting machine may (if required) transmit an all-acknowledge command signal to all detonator assemblies simultaneously, all of the detonator assemblies may respond simultaneously, and the receiver may receive all acknowledge signals from the detonator assemblies simultaneously, the receiver differentiating the incoming acknowledge signals, thereby completing a successful detonator assembly roll-call.

In other exemplary embodiments of the invention, each identification parameter may comprise a time of transmission for each acknowledge signal by each detonator assembly, or a time or receipt of each acknowledge signal by each receiver (resulting from countdown of a pre-programmed anti-collision response time by an internal clock in each detonator), said at least one receiver differentiating said acknowledge signals in accordance with their time of receipt. In most preferred embodiments, the anti-collision response times are chosen and programmed into each detonator assembly so that there can be no overlap between acknowledge signals transmitted at the blast site, either due to their duration, or due to any lag in transmission of signals for example due to the proximity of detonator assemblies relative to the receiver. If required, at least in preferred embodiments, any lag may be compensated, for example in accordance with the teachings of international patent application PCT/AU2006/001619 filed Oct. 27, 2006, which is incorporated herein by reference. This allows for 'on-chip' calibration of clocks within detonators or detonator assemblies. For example, each detonator may include a data register into which a desired delay time value, supplied by a controller, is written. Subsequently, over a predetermined time period (t) the contents of the data register is repeatedly added to a counter register in which the contents is accumulated. After a division of the counter register contents through the calibration time, the contents of the counter register is subsequently counted down using the same oscillator which controlled the accumulation process. In this way, the invention disclosed in PCT/AU2006/001619 allows the delay time value supplied by the controller to be exactly adhered with, using an oscillator of low accuracy and without feedback from the detonator to the controller. Alternatively, calibration of detonator clocks, or any other means, may be used to compensate for any lag in signal transmissions, if present. Embodiments of the invention, involving identification of detonator assemblies based upon a time of transmission or receipt of acknowledge signals, encompass particularly preferred embodiments of the invention and will be described in even greater detail below.

The invention also provides, in still further exemplary embodiments, for methods for checking that at least two detonator assemblies form operative components of a blasting apparatus at a blast site. The methods may comprise the steps of:

(1) programming each detonator assembly with an identification parameter;

(2) transmitting from at least one blasting machine an all-acknowledge command signal for receipt by the detonator assemblies;

(3) transmitting from each detonator assembly, in response to said all-acknowledge command signal, an acknowledge signal indicative of its identification parameter, to at least one receiver optionally forming part of said at least one blasting machine, said at least one receiver differentiating said acknowledge signals in accordance with their identification parameters thereby permitting differentiation of said acknowledge signals by said receiver, and confirmation that each detonator assembly forms a functional component of the blasting apparatus.

As previously discussed, each identification parameter may take any form sufficient and suitable to permit differentiation of incoming acknowledge signals by the receiver(s). For example, the identification parameter may be a transmission frequency or a time of transmission for each acknowledge signal.

The invention will now be described with reference to specific examples describing selected embodiments of the apparatuses and methods of the invention. These examples are in no way intended to be limiting, and are provided merely for illustrative purposes.

Example 1

Preferred Blasting Apparatus Involving Differentiation of Acknowledge Signals Based Upon their Time of Transmission or Receipt Turning now to FIG. 1, there is illustrated a blasting apparatus shown generally at 10. The apparatus comprises at least one blasting machine 11 (only one is shown for simplicity). At least one blasting machine 11 is capable of transmitting an "all-acknowledge" command signal 20 via wired or wireless communication.

The apparatus further comprises detonator assemblies 12*a*, 12*b*, 12*c* for receiving the all-acknowledge command signal 20 from blasting machine 11. Each detonator assembly comprises a detonator 13*a*, 13*b*, 13*c*, including a base charge 14*a*, 14*b*, 14*c*. Each detonator assembly further comprises a memory 15*a*, 15*b*, 15*c* for storing an anti-collision response time. In this example, no two acknowledge signals transmitted by different detonator assemblies of the blasting apparatus are identical. Each detonator assembly still further comprises a clock 16*a*, 16*b*, 16*c* for counting down the anti-collision response time associated with each detonator assembly, upon receipt from said at least one blasting machine of an all-acknowledge command signal, as well as a transmitter 17*a*, 17*b*, 17*c* for transmitting an acknowledge signal in response to said all-acknowledge command signal, upon expiry of said anti-collision response time. The blasting apparatus further comprises at least one receiver 18, optionally integrated into said at least one blasting machine, for receiving said acknowledge signals from said detonator assemblies, and differentiating each acknowledge signal in accordance with its initial time of receipt. In this way, the blasting apparatus verifies communication with each detonator assembly, thereby to effect a "roll-call" of the detonator assemblies present.

The blasting apparatus shown in FIG. 1 therefore allows for parallel or at least partially parallel communication of acknowledge signals from a plurality of detonator assemblies to a receiver. Nonetheless, the acknowledge signals transmitted by each detonator assembly need not be complex in nature, and in their simplest form may comprise minimal data for the receiver to register their receipt. Each acknowledge signal is effectively 'tagged' with an identifying feature indicative of its source detonator assembly by virtue of its time of transmission by a detonator assembly, or time of receipt by a receiver. In this way, the data contents of the acknowledge signals are not complicated by identification data, since the initial time of transmission or receipt is sufficient to provide this information. For example, each receiver may determine a source detonator assembly for each acknowledge signal, either by way of a time of initial receipt of each acknowledge signal relative to initial receipt of other acknowledge signals, or relative to a pre-determined time zero.

Example 2

Figure 2A:
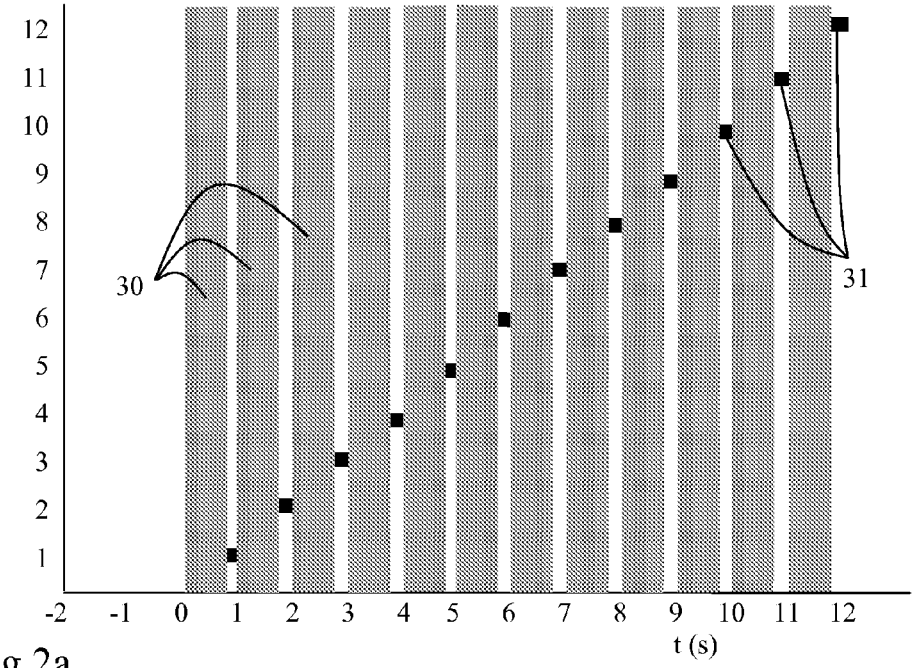
FIG. 2*a* graphically illustrates a sample transfer of signals for a roll-call of detonator assemblies in a blasting apparatus of the prior art involving serial communications.
Figure 2B:
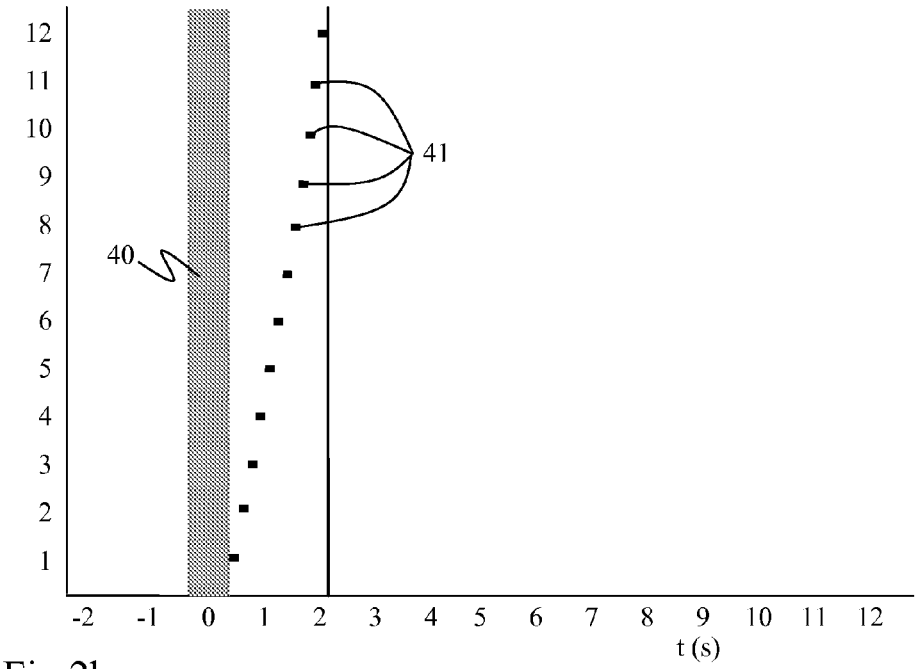
FIG. 2*b* graphically illustrates a sample transfer of signals for a roll-call of detonator assemblies in a blasting apparatus of the present invention.
Figure 2C:
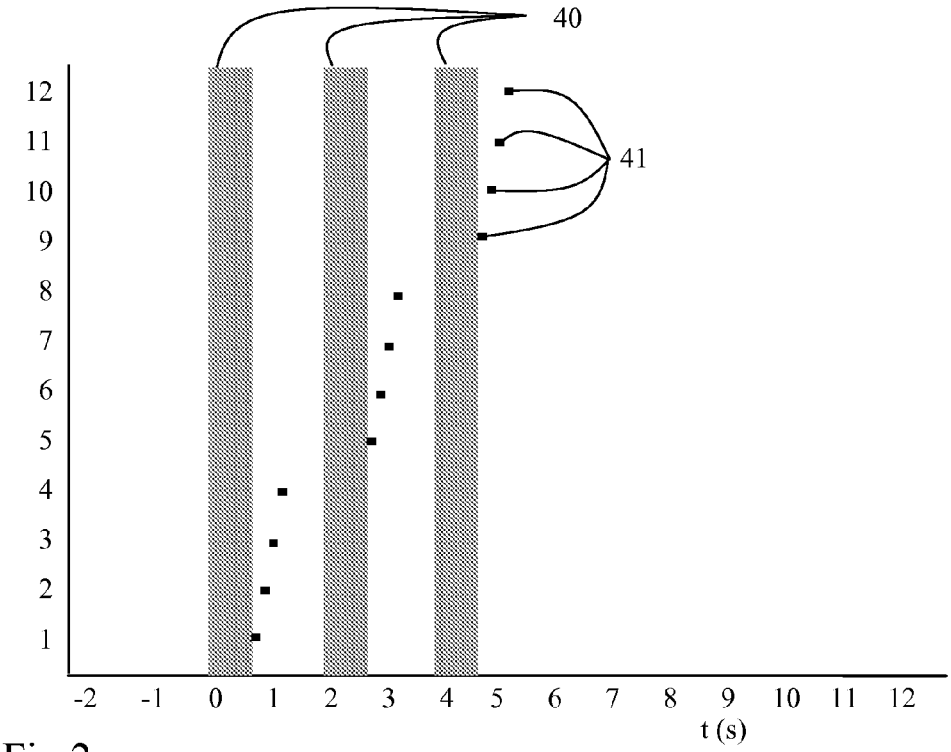
FIG. 2*c* graphically illustrates a sample transfer of signals for a roll-call of detonator assemblies in a blasting apparatus of the present invention.
Figure 2D:
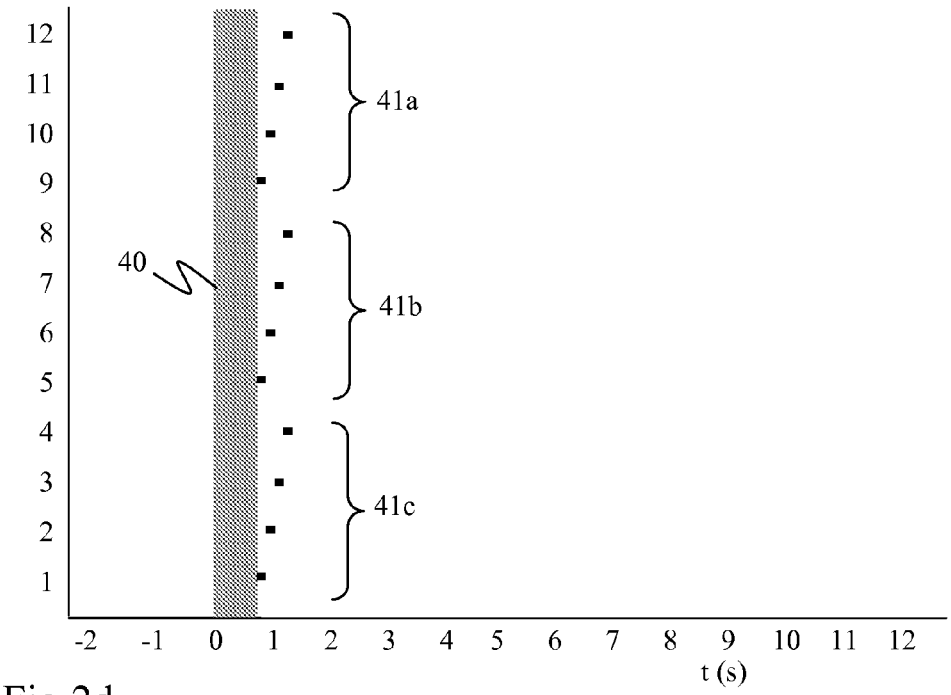
FIG. 2*d* graphically illustrates a sample transfer of signals for a roll-call of detonator assemblies in a blasting apparatus of the present invention.

Comparison of Detonator Assembly Roll-Calls for Serial Communications Of the Prior Art, and Various Embodiments of Communications of the Present Invention FIG. 2 provides a schematic, graphical comparison of a detonator assembly roll-call based upon serial communication (FIG. 2*a*: prior art), and various embodiments of the present invention (FIGS. 2*b*, 2*c*, 2*d*). Each graph provides a detonator assembly number (y-axis) plotted against elapsed time (x-axis), with transmission by a blasting machine of role call signals (FIG. 2*a*) or an "all-acknowledge" signal (FIGS. 2 *b* and 2*c*) indicated by vertical bars, and the black dots on each graph indicating receipt by a receiver of an acknowledge signal from each detonator assembly. In FIG. 2*a* (prior art) serial communication involves separate interrogation of each detonator assembly by the blasting machine (each roll-call signal being indicated by a vertical bar 30), such that the receiver waits for a response signal 31 from each detonator assembly before the next detonator assembly is then contacted. A significant amount of time elapses before the roll-call process is complete: in this case 12 seconds for the interrogation of 12 detonator assemblies.

In contrast, FIG. 2*b* schematically illustrates a roll-call using a blasting apparatus of the present invention, in which an all-acknowledge command signal 40 is transmitted at a time zero. Since the all-acknowledge command signal 40 is directed to all detonator assemblies in the blasting array, no further transmission by the blasting machine is necessary. The receiver then waits for the detonator assemblies to respond by transmission of acknowledge signals 41. Note how the acknowledge signals 41 (black dots) are transmitted and received in an ordered manner, and each acknowledge signal is transmitted and received at a slightly different time compared with other acknowledge signals. The time of transmission of the acknowledge signal (or the time of initial receipt by a receiver) allows a receiver to differentiate the acknowledge signals. In FIG. 2*b* the total time illustrated for the roll-call of the 12 detonators is less than 2 seconds. However, a skilled artisan will appreciate that an even more rapid roll-call may also be permitted, if the acknowledge signals can be transmitted and received just milliseconds apart. For example, if 1000 detonators are present in a blasting array then a sequence of acknowledge signals 10 ms apart will permit completion of the entire roll-call in about 10 seconds.

FIG. 2*c* illustrates another roll-call using a blasting apparatus of the present invention in which the detonator assemblies are interrogated in 3 separate groups, with all-acknowledge signals 40 being transmitted at different times to each group. In principle this embodiment is identical to that described with reference to FIG. 2*b*, except that the role call for different groups of detonator assemblies is conducted at different times, for example as additional groups of detonator assemblies are incorporated into the blasting array.

FIG. 2*d* illustrates yet another roll-call using a blasting apparatus of the present invention, in which the detonator assemblies are also organized into 3 separate groups, but are all interrogated by a single all-acknowledge signal. The detonator assemblies in the 3 groups respond with acknowledge signals (grouped as 41*a*, 41*b*, 41*c*) in a similar if not identical manner, over a similar if not identical time period. In this embodiment, further variable parameters may be required in order to permit the receiver to distinguish between incoming acknowledge signals from different groups of detonator assemblies. For example, the detonator assemblies of group 1 may be programmed or designed to transmit their acknowledge signals 41*a* at a specific frequency A, the detonator assemblies of groups 2 may be programmed or designed to transmit their acknowledge signals 41*b* at specific frequency B, and the detonator assemblies of group 3 may be programmed or designed to transmit their acknowledge signals 41*c* at specific frequency C. Providing that frequencies A, B, and C are distinguishable by the receiver, groups 1, 2, and 3 of detonator assemblies may transmit their acknowledge signals in accordance with a roll-call similar to that shown in FIG. 2*b*, but over an even shorter time period. In this way, the receiver differentiates the incoming signals based both upon their time of receipt, and also upon their frequency, so that the roll-call can be conducted even more quickly. In still further embodiments, the blasting apparatus or method used in accordance with FIG. 2*d* may involve the use of multiple receivers (or blasting machines), each adapted to receive or expect incoming signals having a specific frequency corresponding to one or more specific groups of detonator assemblies. In this way, each receiver may only be required to differentiate incoming acknowledge signals based upon their time of receipt.

Example 3

Figure 3:
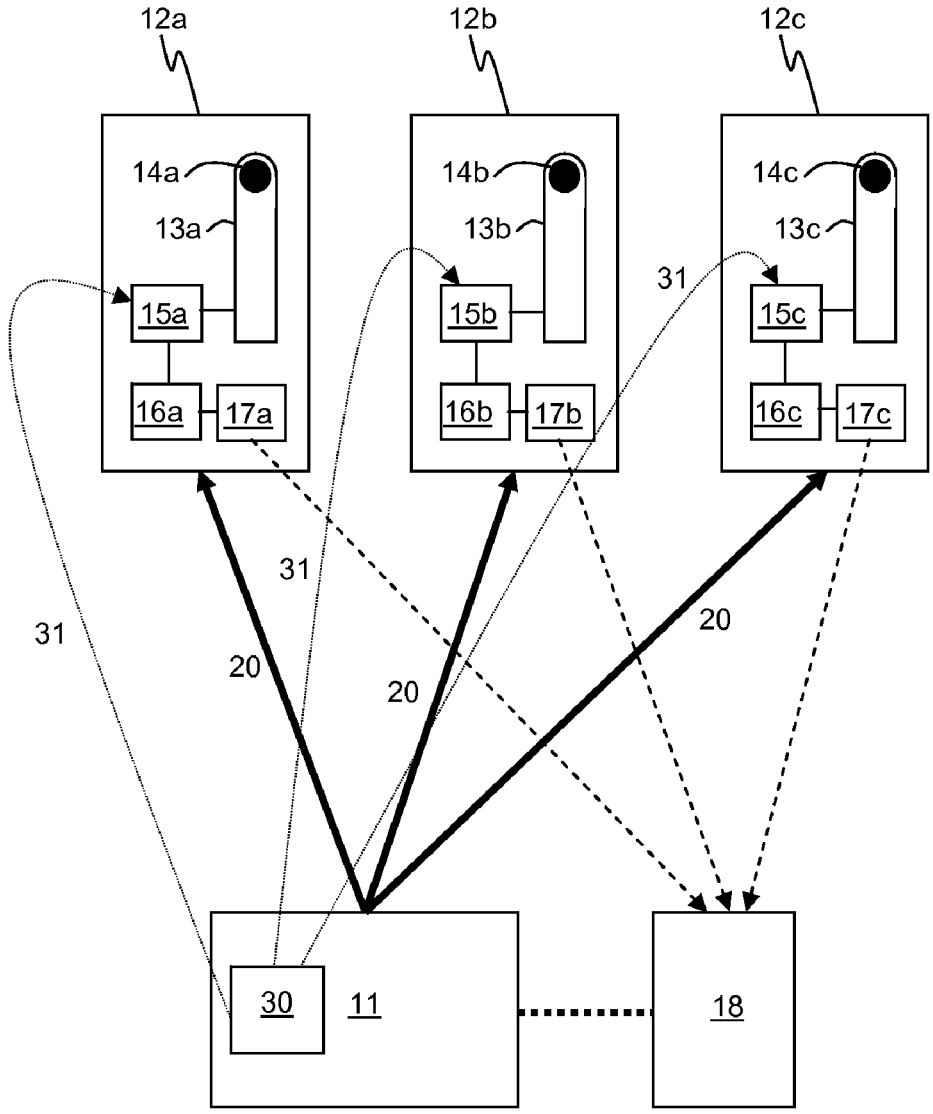
FIG. 3 schematically illustrates a preferred blasting apparatus of the present invention.

Example Means for Programming Detonator Assemblies with Anti-Collision Response Times In further preferred embodiments, consideration may be given to set-up of the blasting apparatuses of the present invention to ensure performance and function as required. Turning now to FIG. 3, there is illustrated a blasting apparatus in which the blasting machine is responsible for generating each anti-collision response time for each detonator assembly, and programming each detonator assembly with its respective anti-collision response time, prior to the roll-call. The blasting machine 11 includes an anti-collision response time generation component 30 for generating anti-collision response times. The blasting machine 11 then transmits anti-collision response times 31 to the detonator assemblies in the blasting array. This embodiment will require that the blasting machine be 'aware' or pre-programmed with detonator identification codes, so that the transmitted anti-collision response times can be coded with detonator identification information. In this way, the transmitted anti-collision response times are properly directed and received by the required detonator assemblies from a location remote from the blast site. The benefit of employing this method derives from the option of sending the anti-collision response times to the detonators before the relevant section of the mine has been cleared (and when time is less precious). Then the faster parallel programming described here can be used during the blasting window.

Figure 4:
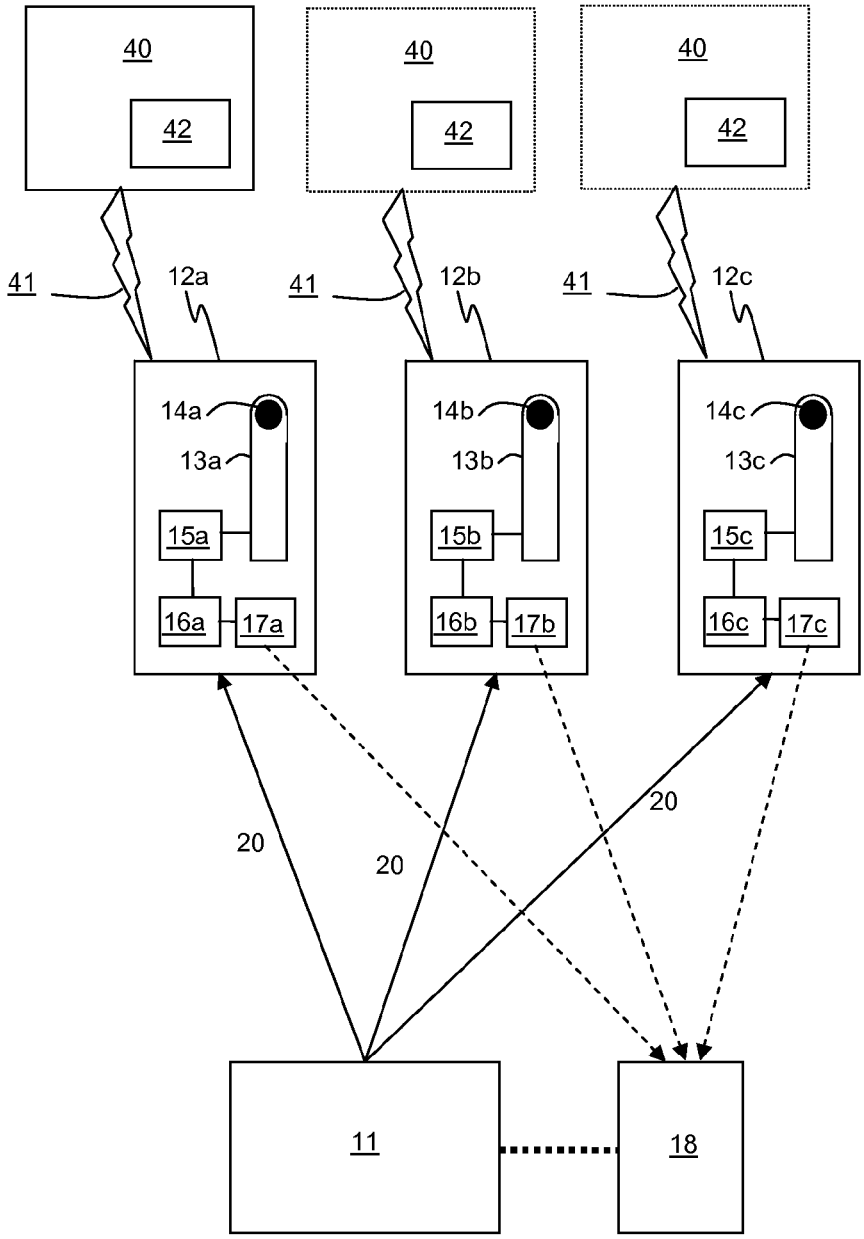
FIG. 4 schematically illustrates a preferred blasting apparatus of the present invention.

In alternative embodiments to that illustrated in FIG. 3, the detonator assemblies may be programmed with anti-collision response times following their placement at the blast site, via a portable programming device such as a logger. In FIG. 4 there is shown a blasting apparatus similar to that shown in FIG. 1, but including logger 40. The logger 40 communicates via one-way or two-way communication with each detonator via short range wired or wireless communication 41. The logger includes an anti-collision response time generating means 42 that permits the logger to assign an anti-collision response time to each detonator assembly during communication 41. The programming of such anti-collision response times may represent the primary function of the logger, or alternatively may be in addition to the logger's routine duties of logging detonators at the blast site. The logger may assign both an anti-collision response time to each detonator assembly as well as an identification code for each detonator assembly, and optionally firing codes and/or delay times. Alternatively, detonator identification codes and/or firing codes and/or delay times may be pre-assigned to a detonator or detonator assembly prior to positioning at the blast site. A logger may also retrieve information of any type from a detonator assembly including but not limited to anti-collision response times, detonator identification codes, firing codes, delay times, or information regarding the status or environmental conditions of the detonator assembly.

In any event, the logger may be carried to each detonator assembly in turn at the blast site to collect information therefrom and/or transmit information thereto. In selected embodiments the use of a logger is particularly preferred. Loggers are commonly used in the blasting apparatuses and methods of the prior art. Allocation of anti-collision response times to detonator assemblies during the logging phase of a blasting event would therefore present little or no inconvenience to the blast operator, and add little or no time to the set-up of the blasting apparatus at the blast site. The logger would record a list of identified detonator assemblies present for the blasting event and positioned at the blast site, together with their allocated anti-collision response times and any other relevant information (e.g. firing codes or delay times, detonator status information etc.) Such information can then be downloaded 43 from the logger 40 to the blasting machine 11 and/or the receiver 18, so that the blasting machine and/or the receiver become fully 'aware' of the detonator assemblies at the blast site, and their allocated anti-collision response times. In this way, the blasting machine and/or receiver know to 'expect' acknowledge signals during a detonator assembly roll-call following transmission by the blasting machine of an all-acknowledge command signal to the detonator assemblies.

In selected embodiments of the blasting apparatus or methods of the invention, the blasting machine, the logger, or any other portable programming device may assign a response number to each detonator assembly, indicative of a sequence in which the detonator assemblies respond upon receipt of an all-acknowledge command. In such embodiments, each anti-collision response time will be calculated by each detonator assembly based upon its assigned response number. For example, for 10 detonator assemblies in a blasting array may be allocated response numbers from 1 to 10. Each detonator may then calculate its response time in milliseconds as: response number×30. In this way, detonator assembly 1 will transmit an acknowledge signal 1×30=30 ms following receipt and processing of an all-acknowledge signal, whereas detonator assembly 10 will transmit an acknowledge signal 10×30=300 ms after receipt and processing of the all-acknowledge signal. Remaining detonator assemblies 2 to 9 will transmit their acknowledge signals as an equally spaced sequence between detonator assembly 1 and 10. The pre-programming of the detonator assemblies to receive and process a unique response number therefore presents a simple yet effective means to ensure the acknowledge signals are transmitted in an orderly sequence, substantially free from interference or collision between the acknowledge signals.

Programming of identification parameters into the detonator assemblies prior to any detonator roll-call represents and important preferred aspect of the present invention. Such identification parameters, regardless of the programming mechanism, provide the detonator assemblies with the means to properly identify themselves to one or more receivers during the roll-call process, thereby permitting rapid communication for the roll-call with minimal risk of signal collision.

Regardless how the detonators are programmed with anti-collision response times, the detonator programming preferably involves the use of inherently safe voltages lower than a threshold voltage for firing each detonator. This eliminates a risk of inadvertent detonator actuation during a programming phase of a blasting event.

Example 4

Preferred Additional Safeguards for Incorporation into the Blasting Apparatuses and Methods of the Present Invention Still further embodiments of the invention may involve one or more additional safeguards to ensure proper execution of the blasting event. For example the invention encompasses the use of detonator assemblies that, upon receipt of an all-acknowledge signal, are able to transmit a warning signal indicating that they have not been programmed with the required information for a detonator assembly roll-call and/or for completion of a blasting event. In selected embodiments, a warning signal may be transmitted by a detonator assembly upon receipt of an all-acknowledge signal, if the detonator assembly has not been pre-programmed with an anti-collision response time. Effectively, the warning signal provides the blasting apparatus or blast operator with some indication that the detonator assembly is not able to respond properly during the roll-call. For example, the occurrence of a warning signal may indicate that a particular detonator or detonator assembly has not been properly visited by a portable electronic device or logged by a suitable logger. In selected embodiments, each warning signal may have a content similar or identical to that of an acknowledge signal, but may be transmitted at a specific time following receipt of the all-acknowledge command signal that is different to a time of transmission of any of the acknowledge signals. In selected embodiments, each specific time for each warning signal may need to be a random or pre-determined time within a timeframe or time window generally separate to a time window for the roll-call, to help avoid collision between warning signals and/or warning signals and acknowledge signals. In this way, the receiver may more readily differentiate each warning signal from the acknowledge signals. Each warning signal may take a very simple form, or may include more complex data such as identification information for the detonator assembly. In most preferred embodiments, the receiver may be programmed to 'expect' acknowledge signals of a predetermined number, or in a predetermined sequence, from the detonator assemblies, such that failure of a detonator assembly to transmit an acknowledge signal is detected by said receiver due to its absence from the predetermined number or predetermined sequence of acknowledge signals.

Example 5

Clock Calibration for Detonator Assemblies

As previously discussed, selected embodiments of the present invention involve the allocation of an anti-collision response time to each detonator assembly. Each anti-collision response time effectively assigns an identifying parameter to each detonator assembly. However, for the anti-collision response times to operate effectively in the blasting array, the detonator assemblies typically include clocks that are properly calibrated relative to one another. The use of poorly calibrated clocks could result in acknowledge signal collision, since the anti-collision response times will not be counted down in an equivalent manner between the detonator assemblies at the blast site. Hence, another important preferred aspect of the blasting apparatuses and methods of the invention involves some form of calibration of the internal clocks of the detonator assemblies present. For example, the clocks of the detonator assemblies may be calibrated upon manufacture thereof. However, such clocks would need to be very accurate if substantial clock drift is to be avoided between the point of manufacture and the point of use at the blast site.

In other embodiments, the clocks may be calibrated at the blast site via any suitable means. For example, the at least one blasting machine or another component of the blasting apparatus may transmit a carrier signal, each clock employing phase-lock technology to phase lock the clocks with the carrier signal, thereby to improve synchronization of the clocks. In situ calibration of the clocks at the blast site may also be achieved in accordance with the teachings of international patent application PCT/AU2006/001619 filed Oct. 27, 2006, which is incorporated herein by reference. In other embodiments, the logger may comprise a clock calibration component such as an internal calibration clock or short-range carrier wave, such that the detonator assembly clocks are calibrated through communication with the logger during a logging phase of the blasting event.

The clock may also be calibrated upon manufacture thereof, or upon manufacture of corresponding detonator assemblies incorporating the clocks, and each clock may comprises a crystal or ceramic oscillator.

Example 6

A Detonator Assembly

The present invention also provides, in selected embodiments, for a detonator assembly for use in connection with the blasting apparatus or in a method of the present invention. In its basic form, the detonator assembly of the present invention may comprise:

(i) a detonator including a base charge;

(ii) a dedicated memory for storing an anti-collision response time;

(iii) a clock for counting down the anti-collision response time when stored in the dedicated memory upon receipt from a blasting machine of an all-acknowledge command signal; and (iv) a transmitter for transmitting an acknowledge signal in response to said all-acknowledge command signal, upon expiry of said anti-collision response time.

Example 7

Figure 5:
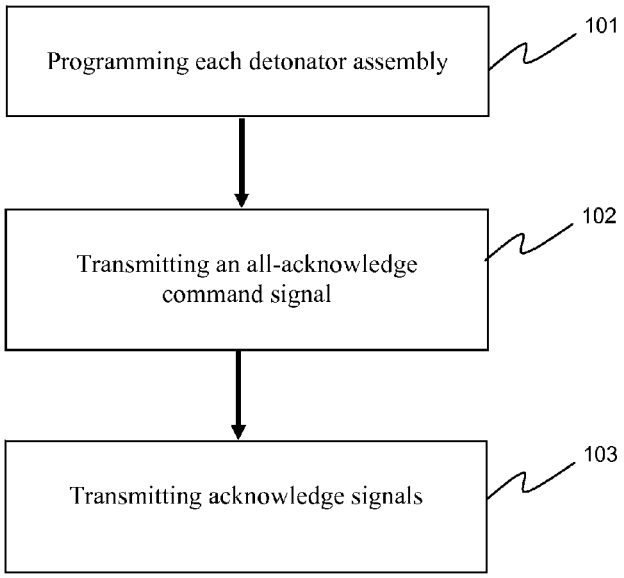
FIG. 5 provides a flow chart illustrating the steps of a preferred method of the invention for checking that at least two detonator assemblies present at a blast site form operative components of a blasting apparatus.

Methods Involving the Use of Identification Parameters for Detonator Assemblies, Comprising Anti-Collision Response Times FIG. 5 illustrates a preferred method of the present invention involving the use of anti-collision response times as identification parameters for detonator assemblies. The method conducts a detonator assembly roll-call to check that at least two detonator assemblies form operative components of a blasting apparatus at a blast site.

In step 101 the method involves programming each detonator assembly with an anti-collision response time.

In step 102 the method involves transmitting from at least one blasting machine an all-acknowledge command signal for receipt by the detonator assemblies, to cause each detonator assembly to count-down its programmed anti-collision response time.

In step 103 the method involves transmitting from each detonator assembly, upon completion of count-down of its programmed anti-collision response time, an acknowledge signal to at least one receiver optionally forming part of said at least one blasting machine. The time of initial receipt by the at least one receiver of each acknowledge signal preferably occurs at a time different to initial receipt of every other acknowledge signal. Therefore, differentiation of the acknowledge signals by the receiver is permitted, thereby providing confirmation that each detonator assembly forms an operative component of the blasting apparatus. Preferably, in step 103 the at least one receiver processes and differentiates incoming acknowledge signals, and if required determines a detonator assembly from which each acknowledge signal is derived, by way of a time of receipt of each acknowledge signal relative to receipt of other acknowledge signals, or relative to a time zero. As previously discussed with respect to FIG. 2, in preferred embodiments at least two of the acknowledge signals transmitted by said detonator assemblies may temporally overlap, thereby further reducing the time required for a detonator roll-call.

In the methods of the present invention, each anti-collision response time may be programmed into each detonator assembly via any means, including but not limited to, factory programming, or programming via communication with a blasting machine, logger, or any other component of the blasting apparatus, either prior to or following placement at the blast site.

In preferred embodiments, the methods of the invention, between steps 101 and 103 of FIG. 5, may include the further step of:

downloading the blast site information from a portable programming device into the at least one blasting machine, so that following transmission by the at least one blasting machine of the all-acknowledge command signal, and subsequent receipt by the blasting machine of the acknowledge signals from the at least two detonator assemblies, the at least one blasting machine associates each acknowledge signal with each detonator assembly in accordance with the blast site information.

Preferably in step 101 of FIG. 5, the portable programming device assigns a unique response number to each detonator assembly, indicative of a sequence in which the detonator assemblies respond upon receipt in step 102 of an all-acknowledge command signal, each anti-collision response time being calculated by each detonator assembly based upon its assigned response number.

In other preferred embodiments of the methods of the invention, the anti-collision response times of the detonator assemblies include a series of anti-collision response times substantially equally temporally spaced, such that transmission by the at least one blasting machine of an all-acknowledge command signal to the detonator assemblies causes transmission by the detonator assemblies in step 103 of a regularly temporally spaced sequence of the acknowledge signals for receipt by the at least one receiver.

The preferred methods of the invention may further include further safeguard means and/or clock calibration means in accordance with Examples 4 and 5 previously described.

The invention further provides for a use of a blasting apparatus of the present invention, to verify communication with components of the blasting apparatus.

The invention further provides for the use of a blasting apparatus of the present invention, in a mining operation.

Whilst the invention has been described with reference to specific embodiments of the blasting apparatuses, components thereof, and methods of blasting involving such apparatuses and components, such embodiments are merely intended to be illustrative of the invention and are in no way intended to be limiting. Other embodiments exist that have not been specifically described which nonetheless lie within the scope of the invention. It is the intention to include all such embodiments within the scope of the appended claims.

We claim:

1. A blasting apparatus comprising:

(1) at least one blasting machine for transmitting at least one command signal to at least two associated detonator assemblies, at least including an all-acknowledge command signal for receipt by said at least two detonator assemblies;

(2) at least two detonator assemblies, each detonator assembly comprising:

(i) a detonator including a base charge;

(ii) a memory for storing an anti-collision response time;

(iii) a clock for counting down the anti-collision response time upon receipt from said at least one blasting machine of said all-acknowledge command signal; and (iv) a transmitter for transmitting an acknowledge signal in response to said all-acknowledge command signal, upon expiry of said anti-collision response time;

and (3) at least one receiver, optionally integrated into said at least one blasting machine, for receiving said acknowledge signals from said detonator assemblies, and differentiating each acknowledge signal from at least one other acknowledge signal in accordance with its time of receipt, thereby to verify communication with each detonator assembly of said blasting apparatus.

2. The blasting apparatus of claim 1, wherein said at least one receiver processes and differentiates incoming acknowledge signals, and if required determines from which detonator assembly each acknowledge signal is derived, by way of a time of receipt of each acknowledge signal relative to other acknowledge signals, or relative to a time zero.

3. The blasting apparatus of claim 2, wherein each detonator assembly is programmed with an anti-collision response time that is different from anti-collision response times programmed into all other detonator assemblies in the blasting apparatus, so that the at least one receiver differentiates each acknowledge signal from all other acknowledge signals in accordance with its time of receipt.

4. The blasting apparatus of claim 1, wherein the blasting apparatus further comprises a portable programming device for programming each detonator assembly with its anti-collision response time via short-range communication, after placement of each detonator assembly at the blast site.

5. The blasting apparatus of claim 4, wherein the portable programming device records blast site information including an identification for each detonator assembly, an anti-collision response time for each detonator assembly, and optionally a delay time for each detonator assembly.

6. The blasting apparatus of claim 5, wherein the logger downloads the blast site information to said at least one blasting machine, and following transmission by said at least one blasting machine of said all-acknowledge command signal, and subsequent receipt by said blasting machine of said acknowledge signals from said at least two detonator assemblies, said at least one blasting machine associating each acknowledge signal with each detonator assembly in accordance with said blast site information.

7. The blasting apparatus of claim 4, wherein the portable programming device assigns a unique response number to each detonator assembly, indicative of a sequence in which the detonator assemblies respond upon receipt of an all-acknowledge command, each anti-collision response time being calculated by each detonator assembly based upon its assigned response number.

8. The blasting apparatus of claim 1, wherein the anti-collision response times of the detonator assemblies include a series of anti-collision response times substantially equally temporally spaced, such that transmission by said at least one blasting machine of an all-acknowledge command signal to said detonator assemblies causes transmission by said detonator assemblies of a regularly temporally spaced sequence of said acknowledge signals for receipt by said receiver.

9. The blasting apparatus of claim 8, wherein the acknowledge signals are received by said at least one receiver from about 0.1 to 100 ms apart.

10. The blasting apparatus of claim 1, wherein any detonator assembly that has not been suitably programmed with an anti-collision response time prior to transmission of said all-acknowledge command signal, is pre-programmed to respond to said all-acknowledge command signal by transmission of a warning signal to warn the receiver or a blast operator that the detonator assembly has not been suitably programmed.

11. The blasting apparatus of claim 10, wherein each warning signal has a content similar or identical to that of an acknowledge signal, but is transmitted at a specific time following receipt of the all-acknowledge command signal that is different to a time of transmission of any of the acknowledge signals and optionally different to a time of transmission of any other warning signal, such that the receiver can differentiate each warning signal from the acknowledge signals.

12. The blasting apparatus of claim 10, wherein the warning signal includes data comprising an identification for the detonator.

13. The blasting apparatus of claim 7, wherein the receiver is programmed to expect acknowledge signals of a predetermined number or in a predetermined sequence from said detonator assemblies, such that failure of a detonator assembly to transmit an acknowledge signal is detected by said receiver due to its absence from the predetermined number or predetermined sequence of acknowledge signals.

14. A detonator assembly for use in connection with the blasting apparatus of claim 1, the detonator assembly comprising:

(i) a detonator including a base charge;

(ii) a dedicated memory for storing an anti-collision response time;

(iii) a clock for counting down an anti-collision response time when stored in the memory upon receipt from a blasting machine of an all-acknowledge command signal; and (iv) a transmitter for transmitting an acknowledge signal in response to said all-acknowledge command signal, upon expiry of said anti-collision response time.

15. A method for checking that at least two detonator assemblies form operative components of a blasting apparatus at a blast site, the method comprising the steps of:

(1) programming each detonator assembly with an anti-collision response time;

(2) transmitting from at least one blasting machine an all-acknowledge command signal for receipt by the detonator assemblies, to cause each detonator assembly to count-down its programmed anti-collision response time;

(3) transmitting from each detonator assembly, upon completion of count-down of its programmed anti-collision response time, an acknowledge signal to at least one receiver optionally forming part of said at least one blasting machine, a time of receipt by said at least one receiver of each acknowledge signal occurring at a time different to a time of receipt of at least one other acknowledge signal, thereby permitting differentiation of said acknowledge signals by said receiver, and providing confirmation that each detonator assembly forms a operative component of the blasting apparatus.

16. The method of claim 15, wherein each anti-collision response time differs from every other anti-collision response time, and a time of receipt by said at least one receiver of each acknowledge signal occurs at a time different to a time of receipt of every other acknowledge signal.

17. The method of claim 15, wherein in step (3) the at least one receiver processes and differentiates incoming acknowledge signals, and if required determines a detonator assembly from which each acknowledge signal is derived, by way of a time of receipt of each acknowledge signal relative to other acknowledge signals, or relative to a time zero.

18. The method of claim 15, wherein step (1) comprises programming each detonator assembly with its anti-collision response time via short-range communication, after placement of each detonator assembly at the blast site using a portable programming device.

19. The method of claim 18, wherein the portable programming device records blast site information including an identification for each detonator assembly, an anti-collision response time for each detonator assembly, and optionally a delay time for each detonator assembly.

20. The method of claim 19, wherein between steps (1) and (3) the method further comprises the step of:

downloading the blast site information from the portable programming device into said at least one blasting machine, so that following transmission by said at least one blasting machine of said all-acknowledge command signal, and subsequent receipt by said blasting machine of said acknowledge signals from said at least two detonator assemblies, said at least one blasting machine associates each acknowledge signal with each detonator assembly in accordance with said blast site information.

21. The method of claim 18, wherein in step (1) the portable programming device assigns a unique response number to each detonator assembly, indicative of a sequence in which the detonator assemblies respond upon receipt in step (2) of an all-acknowledge command signal, each anti-collision response time being calculated by each detonator assembly based upon its assigned response number.

22. The method of claim 15, wherein the anti-collision response times of the detonator assemblies include a series of anti-collision response times substantially equally temporally spaced, such that transmission by said at least one blasting machine of an all-acknowledge command signal to said detonator assemblies causes transmission by said detonator assemblies in step (3) of a regularly temporally spaced sequence of said acknowledge signals for receipt by said at least one receiver.

23. The method of claim 22, wherein the acknowledge signals are received by said receiver from about 0.1 to 100 ms apart.

24. The method of claim 18, wherein any detonator assembly that has not been suitably programmed by the portable programming device in step (1), is pre-programmed to respond to said all-acknowledge command signal in step (3) by transmission of a warning signal to warn the receiver or a blast operator that the detonator assembly has not been visited by the portable programming device.

25. The method of claim 24, wherein each warning signal has a content similar or identical to that of an acknowledge signal, but is transmitted at a specific time following receipt of the all-acknowledge command signal that is different to a time of transmission of any of the acknowledge signals and optionally different to a time of transmission of every other warning signal, such that the receiver can differentiate each warning signal from the acknowledge signals.

26. The method of claim 24, wherein each warning signal includes data comprising a factory encoded identification for the detonator.

27. The method of claim 22, wherein in step (3) the receiver is programmed to expect acknowledge signals of a predetermined number or in a predetermined sequence from said detonator assemblies, such that failure of a detonator assembly to transmit an acknowledge signal is detected by said receiver due to its absence from the predetermined number or predetermined sequence of acknowledge signals.

28. Use of a blasting apparatus of claim 1, to verify communication with components of the blasting apparatus.

* * * * *